United States Patent [19]

Wellman et al.

[11] Patent Number: 5,022,252

[45] Date of Patent: Jun. 11, 1991

[54] EXTRUDING APPARATUS FOR EXTRUDING STEPPED PRODUCTS

[75] Inventors: Keith R. Wellman, Wimborne; Robert L. Crellin, Workington; William L. Ostle, Maryport, all of England

[73] Assignee: Alcan International Limited, Canada

[21] Appl. No.: 481,331

[22] Filed: Feb. 20, 1990

[30] Foreign Application Priority Data

Feb. 20, 1989 [GB] United Kingdom ..... 8903815

[51] Int. Cl.[5] ..... B21C 25/08; B21C 25/02

[52] U.S. Cl. ..... 72/260; 72/263; 425/190; 425/381; 425/465; 264/167

[58] Field of Search ..... 425/182, 184, 186, 190, 425/383, 465, 325, 381; 72/260, 263, 255, 467, 468, 276, 282, 285; 264/167

[56] References Cited

U.S. PATENT DOCUMENTS

| | | | |
|---|---|---|---|
| 2,715,459 | 8/1955 | Krause | 72/260 |
| 2,778,493 | 1/1957 | Kreidler | 72/468 |
| 2,899,053 | 8/1959 | Govan | 72/260 |
| 3,540,094 | 11/1970 | Janssen | 425/381 |
| 3,585,834 | 6/1971 | Bruyn et al. | 72/260 |
| 4,793,170 | 12/1988 | Daniels | 72/255 |

FOREIGN PATENT DOCUMENTS

| | | | |
|---|---|---|---|
| 159160 | 12/1963 | U.S.S.R. | 72/260 |
| 848114 | 7/1981 | U.S.S.R. | 72/263 |
| 1461552 | 2/1989 | U.S.S.R. | 72/260 |

*Primary Examiner*—Robert L. Spruill

*Attorney, Agent, or Firm*—Stevens, Davis, Miller & Mosher

[57] ABSTRACT

An apparatus for extruding stepped extrusions, e.g. of aluminum or aluminium alloy, comprises a die holder carrying a major die, and a split minor die arranged for abutment with the downstream side of the major die and having its two halves mounted on respective parts of a split holder. The holder parts are movable towards and away from the line of extrusion to put together and separate the halves of the minor die. The die holder and the container of an extruder are movable towards each other to press the minor die the major die and the downstream face of the container into sealing engagement about the die apertures, and are movable away from each other to permit the extrusion to be sheared off between the container and the major die.

5 Claims, 5 Drawing Sheets

EXTRUDING APPARATUS FOR EXTRUDING STEPPED PRODUCTS

Figure 1:
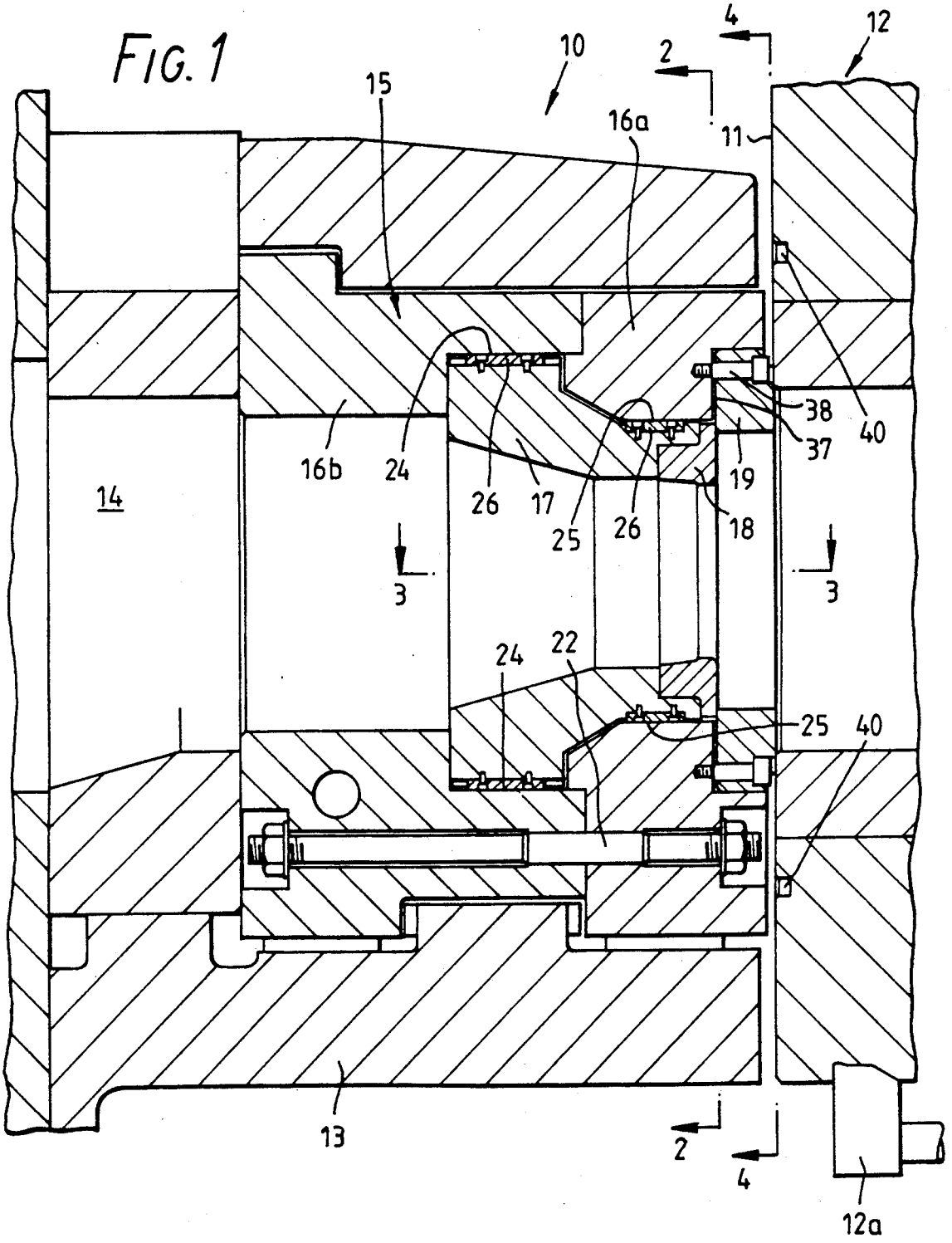

This invention relates to extruding apparatus for the extrusion of e.g. aluminium or aluminium alloy and is more particularly concerned with apparatus capable of producing stepped extrusions i.e. extended lengths in which there is an abrupt change of cross-section, each cross-section being located within the envelope or limits of the next larger cross-section. Such extended lengths are commercially, economically and structurally attractive because they can eliminate machining which is expensive in machining time and wasteful of material, and which may introduce stress locations.

In one such apparatus currently used, a major die providing a larger section die aperture and a split minor die providing a smaller die aperture are disposed in axial abutment with each other, the major die forming effectively the end wall of the container of the extrusion press. Extrusion takes place initially through both of the die apertures in series, so that the aperture of the minor die determines the cross-section of the extension. When the stepped increase in cross-section is desired, the minor die is released from abutment with the major die, so that the die aperture of the major die determines the cross-section of the extrusion, and the split minor die is carried on the extrusion at the location of the step as extrusion proceeds and has subsequently to be separated into its two or more constituent parts to enable it to be removed from the extrusion for re-use. In a variant of this apparatus the minor die is in one piece and is removed axially from the extruded workpiece.

The necessity to remove a die from about the extrusion is wasteful of extrusion time even if a plurality of identical minor dies are maintained in circulation, and an object of the present invention is to provide an apparatus which is capable of manufacturing stepped extrusions without the need to interrupt operations to remove a die from an extruded length incorporating a step.

According to this invention there is provided an extruding apparatus comprising a die block in one end of which is formed a recess for receiving a major die, a sectional holder for a minor die formed in two or more sections which die sections jointly define the full periphery of the die aperture of the minor die, the sections of the holder being adapted to locate the respective sections of the minor die in their correct relative positions and in axial abutment with the downstream or rear face of the major die, said sections of the holder for the minor die being mounted in the die block for movement selectively to bring the minor die sections into said correct relative positions and to separate the minor die sections and move them outward away from each other and from the line of extrusion, and means for so moving the said sections of the holder.

In a preferred apparatus according to the invention, the said section of the holder are mounted for linear sliding movement in slideways formed in die block and extending generally radially with respect to the axis of extrusion.

According to another preferred feature of the invention, the front or upstream face of the major die is arranged for abutment with the rear end face of the container to form a seal with said rear end face of the container, so as on termination of extrusion to enable the discard to be sheared off at the front face of the major die.

According to another preferred feature of the invention, the front face of the minor die projects a small axial distance into the recess for the major die and the major die is secured in said recess by means permitting the major die a small degree of lost motion away from the minor die.

Figure 2:
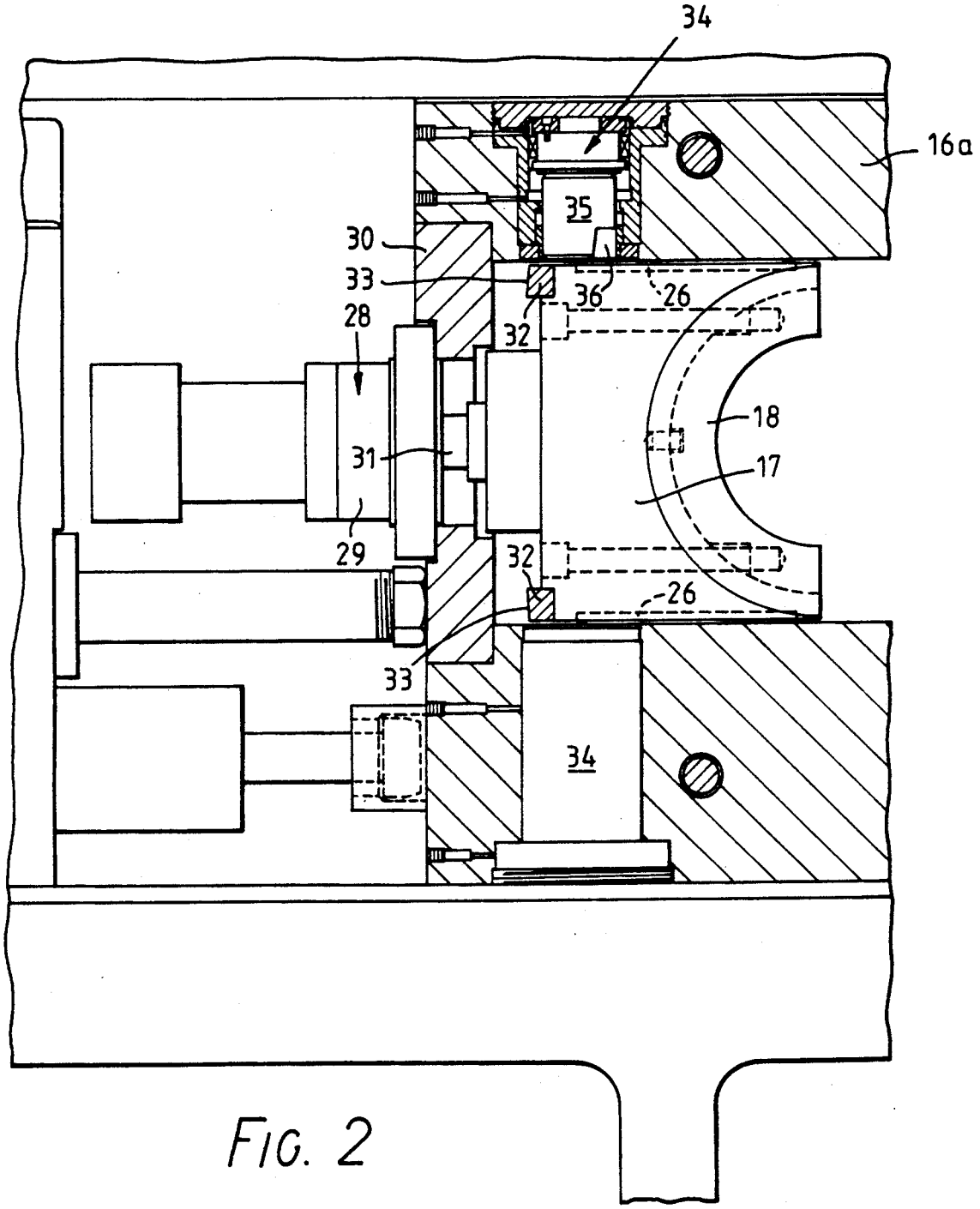
Figure 3:
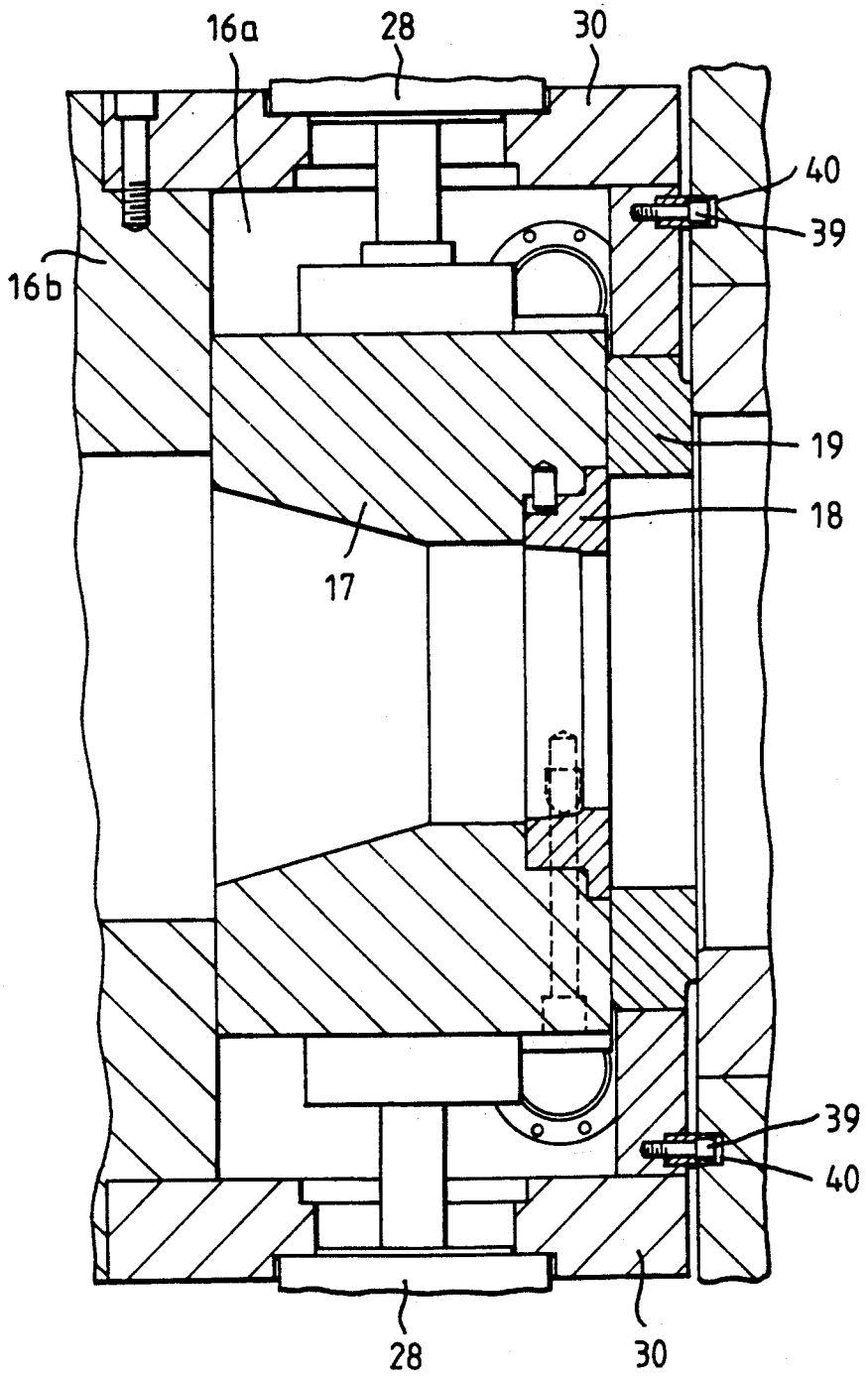
Figure 4:
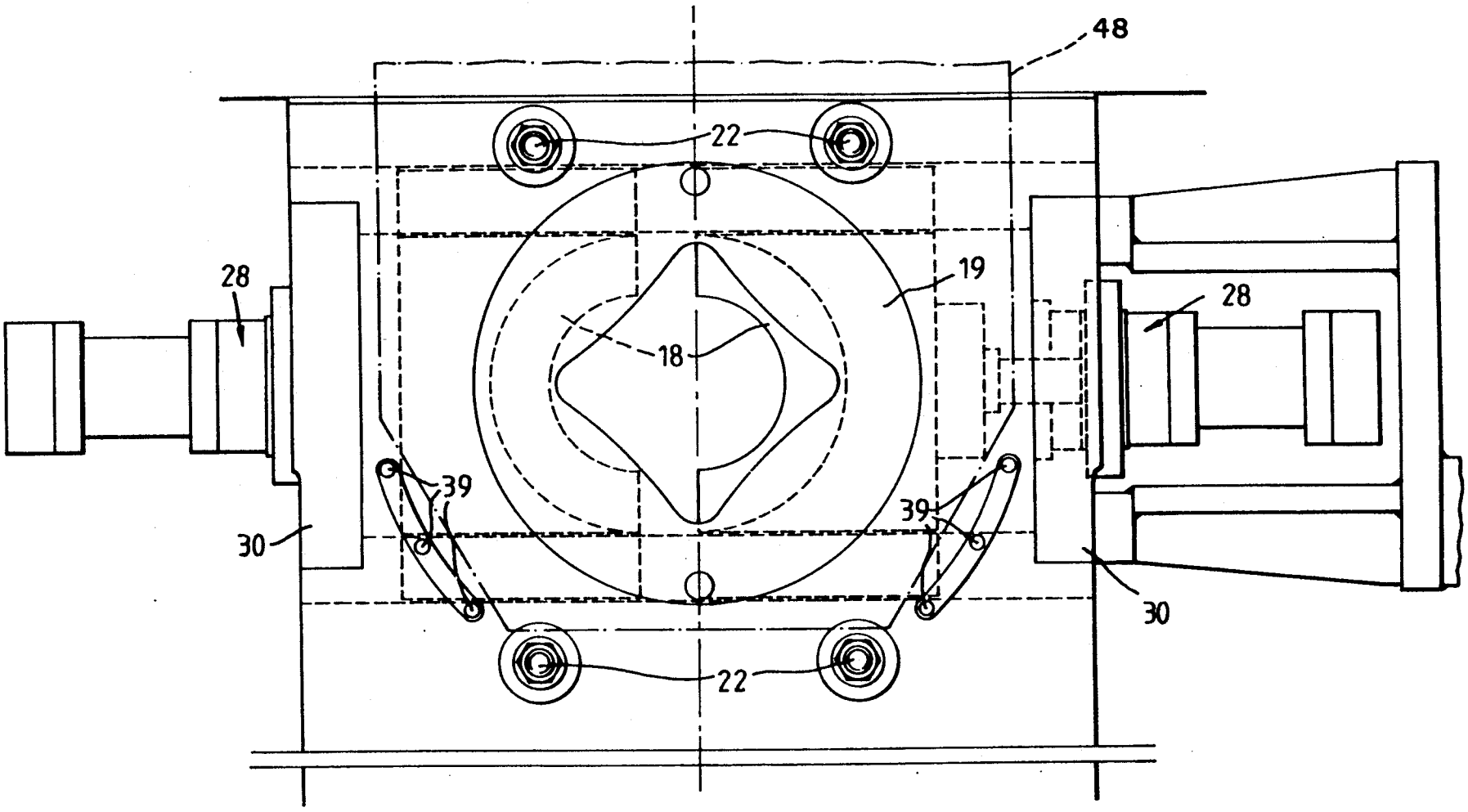
Figure 6:
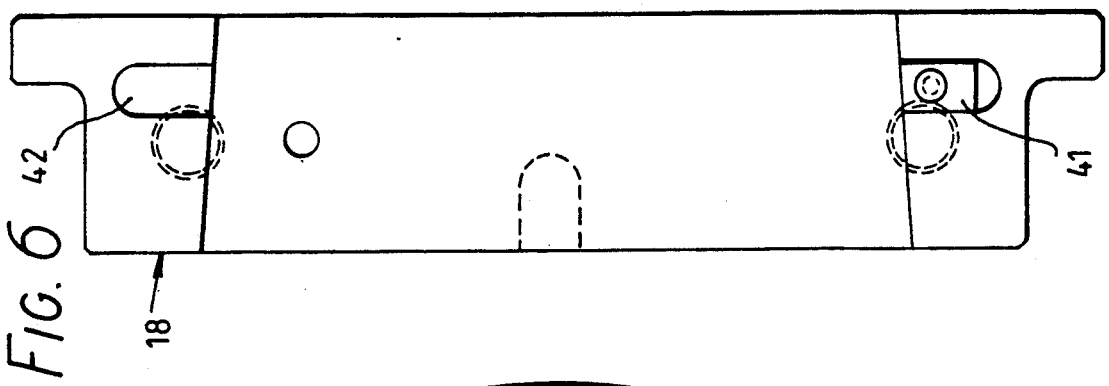
Figure 5:
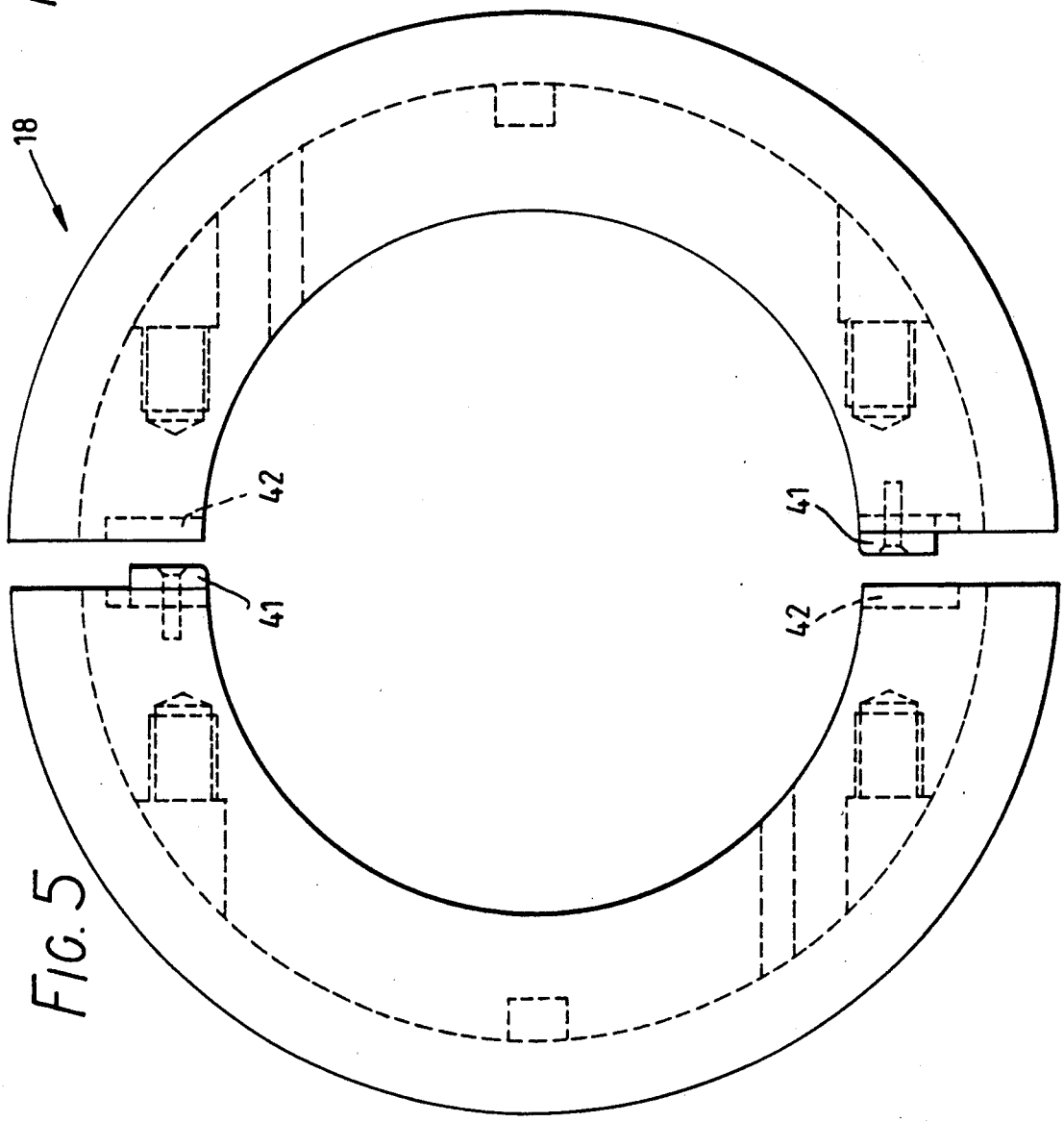

One embodiment of the invention will now be described by way of example with reference to the accompanying drawings in which:

FIG. 1 shows an extruding apparatus according to the invention in axial section, FIG. 2 is a half section on the plane 2—2 of FIG. 1, FIG. 3 is a fragmentary sectional view on the line 3—3 of FIG. 1, FIG. 4 is an end view on the plane 4—4 of FIG. 1, and FIGS. 5 and 6 are respectively an end elevation and sectional elevation of a preferred form of split die for use in the apparatus.

Referring first to FIGS. 1 and 3 of the drawings the extruding apparatus 10 according to the invention is shown in abutment with the rear end face 11 of the container 12 of an extrusion press. The apparatus comprises a die slide bracket 13 supporting at its end further from the container a platen 14 and, between the platen and the container, a die assembly 15.

Assembly 15 includes a die block formed in two parts **16*a*, 16*b*, a split die holder 17, a split minor die 18 and a major die 19. The front and rear parts 16*a*, 16*b* of the die block are held in axial abutment with each other by tie bolts 22, and the rear face of the rear part 16*b* is disposed in abutment with the platen 14. The die block parts 16*a*, 16*b* jointly define two rectilinear channels disposed at opposite sides of the line of extrusion and facing each other which form parallel slideways 24 for the split die holder. Two planar slideways 25 parallel to the slideways 24 are formed on the inner face of the front die block part 16*a*. In the particular arrangement illustrated slideways 24 and 25 are horizontal and the die holder 17** is split vertically.

Referring now also to FIG. 2 of the drawings, each half of the split die holder 17 carries a corresponding half of the split minor die 18 in a recess in its front face, and bronze wear plates are secured to the top and bottom faces of each die holder half for engagement with the slideways 24, 25.

Each half of the die holder 17 is movable towards and away from the line of extrusion by a hydraulic ram 28. The ram cylinders 29 are secured to the outer face of respective vertical side plates 30 which in turn are secured in recesses in opposite sides of the die block parts **16*a*, 16*b* and the actuating rods 31 of the rams are secured to the outer ends of the respective die holder halves. Locking strips 32 having chamfered outer side faces are secured in recesses extending along the top and bottom outer edges of each die holder half. Upper and lower hydraulic rams 34 are mounted in the front die block part 16*a* and each has in the end portion of its actuating rod 35 a notch 36. When the halves of the die holder 17 are in their innermost positions the rams 34 can be actuated to cause their actuating rods 35 to project, so that a face of the notch 36 in each rod engages the chamfered side face 33 of the associated locking strip 32** to lock the die holder halves together. However, the forces on the die holder are such, in operation of the apparatus, that operation of the rams to lock the die holder is often unnecessary.

As shown in FIG. 1, the major die 19 is located in a recess 37 in the front face of the front die block part 16*a* and the front face of the die projects a small distance beyond the die slide bracket 13 and the front part 16*a* of the die block and abuts the adjacent face 11 of the container to form a seal. The major die is secured in its recess by pillar screws 38 engaged in threaded holes in the die block part 16*a*. The heads of the screws are countersunk into the front face of the major die. The central unthreadead section of each pillar screw 38 is slightly longer than the part of the major die through which it extends. The axial dimensions of the minor die are such that the front face of the die projects axially a small distance, say 0.5 mm, into the recess 37 for the major die, and the radially outer edge portion of the projecting face of the minor die bears against the rear face of the major die about the die aperture of the latter so as to form a seal.

In operation of the apparatus to form a stepped extrusion, the two halves of the die holder 17 are moved into abutment by their actuating rams 28 to close the minor die 18 and are locked together by the locking rams 34. The container is then moved by means shown diagrammatically at 12*a* to bring the container into tight sealing engagement with the front face of the major die 19.

The force of this engagement presses the major die 19 rearwards and compresses the minor die 18 and die holder 17 until the major is in firm abutment with the base of the recess 37, so that a tight seal is produced between the rear face of the major die and the front face of the minor die and so that the load on the major die is transmitted to the rear die part 16*b* partly by way of the front die block part 16*a* and partly by compression of the minor die and its holder 17. Extrusion is now commenced, the material passing through the major die but being shaped by extrusion through the minor die. When the length of the extrusion of the smaller section reaches the desired value, the ram pressure in the container is relieved completely and then, when the material in the container is no longer under pressure, the pressure of the container against the major die is reduced, not to zero, but to a value which removes the axial compression forces on the minor die and its holder and results in an axial clearance, perhaps only of the order of 0.025 mm, between the rear face of the major die and the front face of the minor die. The rams 34 are now operated to unlock the two halves of the die holder 17 and rams 28 are then operated to draw the minor die holder halves apart until the die halves are clear of the die aperture of the major die. The container pressure against the major die is then re-imposed, and extrusion is resumed and is shaped by the major die. When the length of the larger section part of the extrusion reaches the desired value, extrusion is stopped, the container is withdrawn and the billet is sheared through at the front face of the major die by a shearing blade 48 indicated in chain lines in FIG. 4. When the extrusion has been removed, the split die halves can be removed inward to their former positions and locked in place to enable the next extrusion to be formed.

If it is desired that the extrusion should be hollow a central mandrel may be employed in any convenient manner. In order to locate the mandrel radially relative to the dies, groups of projections 39 are mounted on the front face of the front part 16*a* of the die block for engagement in complementary holes 40 in the end face 11 of the container.

In a preferred form of split die shown in FIGS. 5 and 6 for use in the illustrated apparatus, a radially extending key 41 is mounted on a flat abutment face of each die half and engages in sealing manner in a complementary slot 42 in a flat abutment face of the other die half. The key and slot extend outward from the edge of the die aperture. In use of the die, if any of the material is forced outward between the die halves by the extrusion pressure, it is sheared off by the keys as extrusion proceeds. It will be apparent that, alternatively, both of the keys may be on one die half and both of the slots in the other die half.

It will be understood that although the apparatus particularly described and illustrated has a single minor die, there may be a further sectional minor die disposed in axial abutment with the rear face of the first minor die and having a smaller die aperture than the first minor die, this further die having its sections mounted in respective parts of a sectional die holder for movement to move the die parts away from and towards each other in substantially the same manner as in the illustrated construction but independently of the operation of the first minor die. Any number of sectional minor dies having decreasing die aperture sizes respectively may similarly be disposed in abutment with each other to produce stepped extrusions with multiple cross-sectional steps.

We claim:

1. An extruding apparatus comprising a die block in one end of which is formed a recess for receiving a major die, a major die having a front or upstream face and a rear face mounted in said recess, a sectional holder for a minor die, a minor die carried by said sectional holder and having a front face and a rear face formed in two or more sections, which die sections jointly define the full periphery of the die aperture of the minor die, the sections of the holder being adapted to locate the respective sections of the minor die in aligned relative positions and in axial abutment with the downstream or rear face of the major die, said sections of the holder for the minor die being mounted in the die block for movement selectively to bring the minor die sections into said aligned relative positions and to separate the minor die sections and move them outward away from each other and from a line of extrusion extending through said major die, and means for so moving the said sections of the holder.

2. Apparatus as claimed in claim 1, wherein the said sections of the holder are mounted for linear sliding movement in slideways formed in the die block and extending generally radially with respect to said line of extrusion.

3. Apparatus as claimed in claim 1, wherein the front or upstream face of the major die is arranged for abutment with a rear end face of an extrudant container to form a seal with said rear end face of the container, so as on termination of extrusion to enable extrudant discard to be sheared off at the front face of the major die.

4. Apparatus as claimed in claim 1, wherein the front face of the minor die projects a small axial distance into the recess for the major die and the major die is secured in said recess by means permitting the major die a small degree of lost motion away from the minor die.

5. An extruding apparatus including an extruder comprising a container having a rear or downstream end face, a die block having a front end face disposed facing said rear end face of the container, a recess in said front end face, a major die disposed in said recess coaxially with the container and arranged to protrude from the recess for abutment with the rear end face of the containers, a minor die formed in a plurality of sections, a die holder formed in a plurality of sections in which the minor die sections are respectively mounted, means for moving the die holder sections towards and away from the line of extrusion to place the minor die sections together and to separate them, the minor die sections when together protruding a small distance into said recess and abutting axially against the face of the major die farthest from the container, means for relatively moving the container and the die axially towards and away from each other to move the front end face of the major die into and out of the abutment with the rear end face of the container, and a shearing blade operable to move between the major die and the container when said major die and the container are out of abutment to shear off an extruded length.

* * * * *